US006897741B2

(12) United States Patent
Ando et al.

(10) Patent No.: US 6,897,741 B2
(45) Date of Patent: May 24, 2005

(54) DIELECTRIC DUPLEXER AND COMMUNICATION APPARATUS HAVING FILTER WITH DIFFERENT DEGREES OF MULTIPLEXING

(75) Inventors: Masamichi Ando, Kyoto (JP); Hiroyuki Kubo, Kusastsu (JP)

(73) Assignee: Murata Manufacturing Co. Ltd (JP)

( * ) Notice: Subject to any disclaimer, the term of this patent is extended or adjusted under 35 U.S.C. 154(b) by 33 days.

(21) Appl. No.: 10/165,402

(22) Filed: Jun. 7, 2002

(65) Prior Publication Data

US 2002/0186103 A1 Dec. 12, 2002

(30) Foreign Application Priority Data

Jun. 8, 2001 (JP) ..... 2001-174467

(51) Int. Cl.[7] ..... H01P 1/213; H01P 1/20
(52) U.S. Cl. ..... 333/134; 333/219.1; 333/202
(58) Field of Search ..... 333/134, 202, 333/219, 219.1

(56) References Cited

U.S. PATENT DOCUMENTS

| | | | | |
|---|---|---|---|---|
| 5,638,037 A | * | 6/1997 | Kurisu et al. | 333/202 |
| 5,783,979 A | * | 7/1998 | Andoh et al. | 333/202 |
| 5,831,496 A | * | 11/1998 | Sonoda et al. | 333/202 |
| 5,898,349 A | * | 4/1999 | Hattori et al. | 333/202 |
| 6,072,378 A | * | 6/2000 | Kurisu et al. | 333/219.1 |

FOREIGN PATENT DOCUMENTS

| | | |
|---|---|---|
| CN | 1269913 A | 10/2000 |
| JP | 05-121904 | 5/1993 |
| JP | 07-226608 | 8/1995 |
| JP | 11-145704 | 5/1999 |
| JP | 11274811 | 10/1999 |
| JP | 2000-022405 | 1/2000 |
| JP | 2000-68708 | 3/2000 |
| JP | 2001-144504 | 5/2001 |
| WO | WO 99/12224 | 3/1999 |

OTHER PUBLICATIONS

Ji–Fuh Liang, et al., "Mixed Modes Dielectric Resonator Filters", IEEE Translation on Microwave Theory and Techniques, IEEE Inc. , New York, vol. 442, No. 12 (Dec. 1994).
Ji–Fuh Liang, et al., "Mixed Modes Dielectric Resonator Loaded Cavity Filters," IEEE MTT–S International Microwave Symposium Digest, San Diego, IEEE, vol. 2, May (1994).
European Search Report dated Jul. 28, 2003.
Chinese Office Action issued Apr. 2, 2004.
Japanese Examination Report issued Jun. 8, 2004 (w/ English translation of relevant portions).

* cited by examiner

*Primary Examiner*—Benny Lee
(74) *Attorney, Agent, or Firm*—Dickstein, Shapiro, Morin & Oshinsky, LLP

(57) ABSTRACT

A small dielectric duplexer using a small TM mode dielectric resonator having a low loss is formed. On the transmission side thereof, TM double mode dielectric resonators and a TM triple mode dielectric resonator are arranged in a line so that their opening surfaces face the same direction. On the receiving side thereof, TM single mode dielectric resonators and a TM triple mode dielectric resonator are also arranged in the same direction in a similar manner as the transmission side. The external dimensions of the plurality of these dielectric resonators are made uniform by selecting a dielectric having a dielectric constant according to the degree of multiplexing. The opening surfaces of the cavities are covered by a panel having input/output terminals, an antenna connection terminal and input/output loops and by a panel having coupling loops. In this manner, a small dielectric duplexer with uniform external dimensions and a low loss is formed.

4 Claims, 3 Drawing Sheets

DIELECTRIC DUPLEXER AND COMMUNICATION APPARATUS HAVING FILTER WITH DIFFERENT DEGREES OF MULTIPLEXING

BACKGROUND OF THE INVENTION

1. Field of the Invention

The present invention relates to a dielectric duplexer using a transverse magnetic (hereinafter referred to as "TM") multiplex mode dielectric resonator and to a communication apparatus comprising the dielectric duplexer.

2. Description of the Related Art

In typical dielectric duplexers comprising a plurality of two or more types of TM mode resonators having different degrees of multiplexing is constructed such that the filter on the transmission side has certain passing characteristics and the filter on the receiving side has certain passing characteristics different from the filter on the transmission side. In such dielectric duplexers, a combination of a plurality of TM mode resonators form the filter on the transmission side and a combination of a plurality of TM mode resonators form the filter on a receiving side.

However, in dielectric duplexers comprising a plurality of such conventional TM mode resonators, there are problems to be solved which are described below.

In general, in dielectric duplexers comprising TM mode resonators, in order to decrease the external size of a duplexer, a dielectric duplexer is formed using a triple mode resonator.

However, in a communication apparatus having incorporated therein a dielectric duplexer comprising TM mode resonators, high power characteristics are often required on the transmission side of the dielectric duplexer. Depending on the input power thereof, if a resonator having a high degree of multiplexing is used, the current density is increased, and characteristics are deteriorated due to generated heat.

On the other hand, the quality factor Q of the triple mode resonator deteriorates by approximately 20% to 30% compared to a double mode resonator. For this reason, when a low insertion loss is required, loss is increased when the degree of multiplexing of the resonator which forms a filter is high.

In order to solve these problems, the degree of multiplexing of the resonator which forms a dielectric duplexer must be decreased. With this, however, the number of resonators is typically increased, thereby increasing the size of the duplexer and the cost.

In order to obtain each of the above-described required characteristics, a method of decreasing the degree of multiplexing of only one of the filters on the transmission side and on the receiving side may be considered. However, since the external dimensions differ between a double mode resonator and a triple mode resonator, the sharing parts between the transmission side and the receiving side is difficult, and the cost is increased. For example, in order to form a triple mode resonator using $TM110_{x+y}$, $TM110_{x-y}$, and TM111 modes, and a double mode resonator using $TM110_x$ and $TM110_y$ modes (or a double mode resonator using $TM110_{x+y}$ and $TM110_{x-y}$ modes) from the same material such that they operate at the same frequency band, the external dimensions of each become different. Specifically, for example, in the 1.8-GHz band, when a material having a specific inductive capacity $\epsilon r$ of 24 is used to form the respective resonators, the triple mode resonator is formed in a square of approximately 25 mm, and the double mode resonator is formed in a square of approximately 35 mm.

Also, where resonators having different degrees of multiplexing are mixed inside a filter on the transmission or the receiving side (for example, to form a filter of seven stages, i.e., two double mode resonators and a triple mode resonator), the external dimensions of the respective parts are not uniform, it is difficult to use parts in common between the transmission side and the receiving side, and the cost is increased. Further, since the external dimensions of the parts differ, an unnecessary space is created, and thus the space within the communication apparatus cannot be fully utilized.

Furthermore, when a combination of TM mode resonators in which the characteristics of a filter on the transmission side and a filter on the receiving side is used with the same specification, the outside shape of the duplexer becomes uniform. However, one of filters on the transmission side and one of the filters on the receiving side is sometimes formed as a filter with more stages than are necessary in terms of required characteristics. As a result, the filter has excessive attenuation characteristics, and becomes inferior to an ideal design in terms of insertion loss. Therefore, it is not possible to simultaneously accomplish a reduced size and a lower loss.

SUMMARY OF THE INVENTION

An object of the present invention is to provide a dielectric duplexer which uses a plurality of TM mode resonators and which has a minimized size and can be used to form a communication apparatus comprising the dielectric duplexer.

To achieve the above-mentioned object, the present invention provides a dielectric duplexer comprising: a dielectric filter on a transmission side and a dielectric filter on a receiving side, the dielectric filter comprising a plurality of TM mode dielectric resonators having a cavity having an opening surface and a dielectric core placed within the cavity, wherein the degree of multiplexing of at least one of the plurality of TM mode dielectric resonators differs from those of the other TM mode dielectric resonators, wherein the dielectric filter is formed in such a way that the TM mode dielectric resonators are arranged side by side in a line so that the opening surfaces of the cavities face in the same direction and that the adjacent TM mode dielectric resonators are coupled to each other, and wherein a combination of TM mode dielectric resonators which form the dielectric filter on the transmission side differs from a combination of TM mode dielectric resonators which form the dielectric filter on the receiving side. As a result, a small dielectric duplexer having a low loss is formed.

In the present invention, a dielectric duplexer is formed in such a way that the dielectric constants of dielectrics from which a TM mode dielectric resonator is formed are different according to the degree of multiplexing of a plurality of TM mode dielectric resonators so that the external dimensions of the cavities are uniform. As a result, even when resonators having different degrees of multiplexing are used, the outer shapes can be made substantially the same. As a consequence, sharing parts, such as a cover or a panel, is made possible, and production costs can be decreased.

Furthermore, in the present invention, a communication apparatus comprising the above-described dielectric duplexer is formed. As a result, a communication apparatus having superior communication characteristics is formed.

DESCRIPTION OF THE PREFERRED EMBODIMENTS

The construction of a dielectric duplexer according to a first embodiment of the present invention will be described below with reference to FIG. 1.

Figure 1:
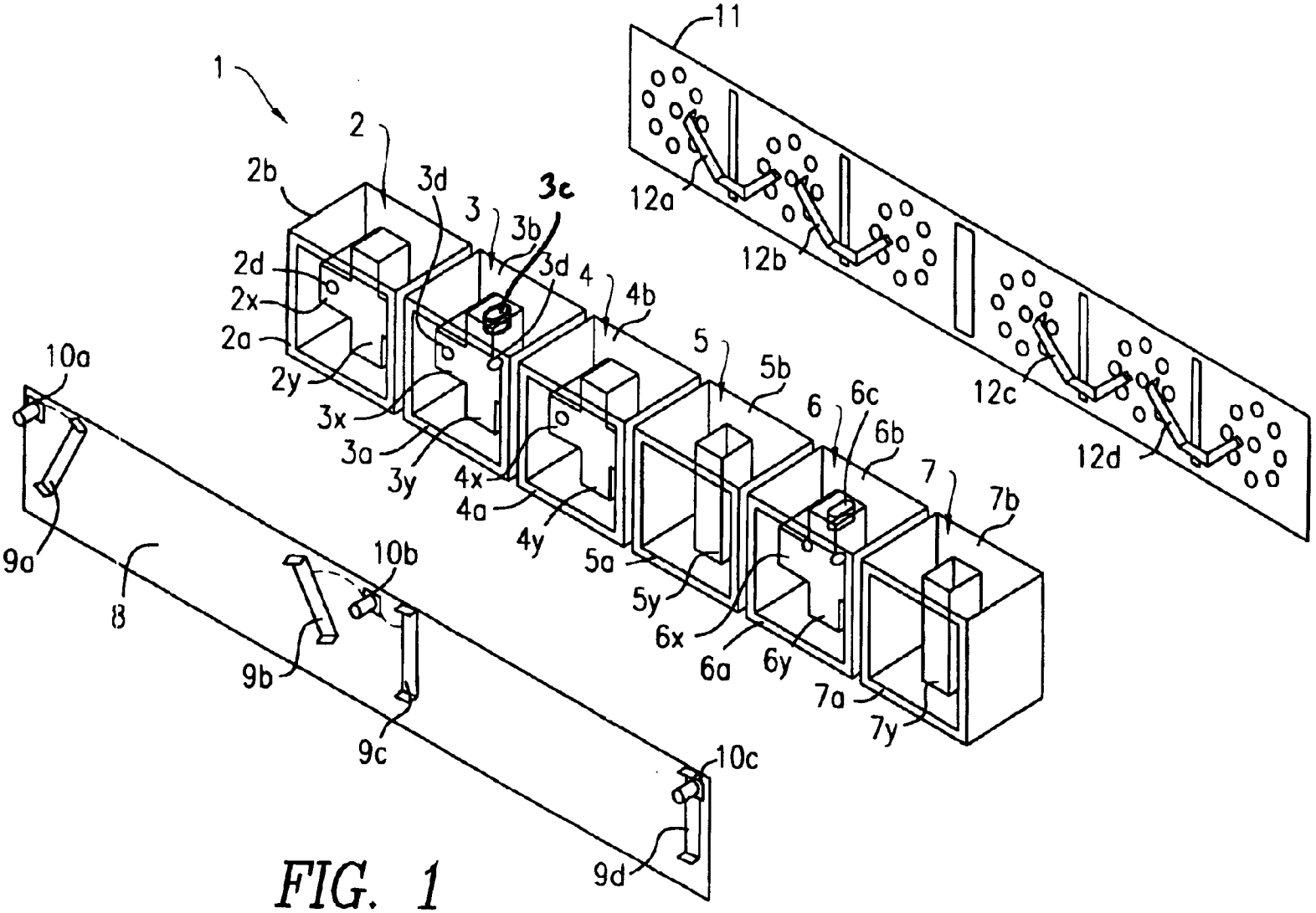
FIG. 1 is an exploded perspective view of a dielectric duplexer according to a first embodiment of the present invention.

Referring to FIG. 1, reference numeral 1 denotes a dielectric duplexer. Reference numerals 2 and 4 denote a TM double mode dielectric resonator. Reference numerals 3 and 6 denote a TM triple mode dielectric resonator. Reference numerals 5 and 7 denote a single mode resonator. Reference numerals 2*a*, 3*a*, 4*a*, 5*a*, 6*a*, and 7*a* denote a cavity. Reference numerals 2*b*, 3*b*, 4*b*, 5*b*, 6*b*, and 7*b* denote a conductor. Reference numerals 2*x*, 3*x*, 4*x*, and 6*x* denote a dielectric core horizontal section. Reference numerals 2*y*, 3*y*, 4*y*, 5*y*, 6*y*, and 7*y* denote a dielectric core vertical section. Reference numerals 3*c* and 6*c* denote a recessed section. Reference numerals 8 and 11 denote a panel. Reference numerals 9*a*, 9*b*, 9*c*, and 9*d* denote an input/output loop. Reference numerals 10*a* and 10*c* denote an input/output terminal. Reference numeral 10*b* denotes an antenna connection terminal. Reference numerals 12*a*, 12*b*, 12*c*, and 12*d* denote a coupling loop.

The TM double mode dielectric resonator 2 includes the cavity 2*a* having openings in two opposing surfaces, and a cross-shaped dielectric core. The cross-shaped dielectric core is formed of the dielectric core horizontal section 2*x* which intersects at right angles to the opposed side surfaces of the cavity 2*a* and the dielectric core vertical section 2*y* which intersects at right angles to the top and bottom surfaces of the conductor 2*b*. the double mode dielectric resonator 2 is preferably integrally formed using a single dielectric material. The conductor 2*b* is formed on the outer surface of the cavity 2*a*. A plurality of holes 2*d* are provided at predetermined positions in the dielectric core horizontal section 2*x*. As a result, the TM$\mathbf{110}_{x+y}$ and the TM$\mathbf{110}_{x-y}$ modes are excited and coupled to each other. The TM double mode dielectric resonator 4 also has the same construction as that of the TM double mode dielectric resonator 2.

The TM triple mode dielectric resonator 3 includes the cavity 3*a* having openings in two opposing surfaces, and a cross-shaped dielectric core. The cross-shaped dielectric core formed of the dielectric core horizontal section 3*x* which intersects at right angles to the opposed side surfaces of the cavity 3*a* and the dielectric core vertical section 3*y* which intersects at right angles to the top and bottom surfaces of the cavity 3*a*. Preferably, the triple mode resonator 3 is integrally formed using a single dielectric material. In the central portion of an end surface of the dielectric core, a section 3*c* which is recessed from the outer wall of the cavity 3*a* toward the inside of the dielectric core is formed. The conductor 3*b* is preferably formed on the entire surface, including the inner surface of the recessed section 3*c*. Furthermore, a plurality of holes/dielectric-free sections 3*d* are provided in the dielectric core. For example, in a corner portion where the dielectric core horizontal section 3*x* and the dielectric core vertical section 3*y* intersect with each other, a plurality of dielectric-free sections 3*d* are provided. As a result, the TM$\mathbf{110}_{x+y}$, TM111, and TM$\mathbf{110}_{x-y}$ modes are coupled to each other. The TM triple mode dielectric resonator 6 also has the same construction as that of the TM triple mode dielectric resonator 3.

The TM single mode dielectric resonator 5 includes the cavity 5*a* having openings in two opposing surfaces, and the dielectric core vertical section 5*y* intersecting at right angles to the top and bottom surfaces of the cavity 5*a*. Preferably, the TM single mode resonator 5 is integrally formed using a single dielectric material. The conductor 5*b* is formed on the outer surface of the cavity 5*a*. The single mode dielectric resonator 7 also has the same construction as that of the resonator 5.

These six dielectric resonators are arranged so that their openings face in the same direction, and the metal panels 8 and 11 are mounted thereto by means such as screws or solder.

On the outer surface of the panel 8, the input/output terminals 10*a* and 10*c*, and the antenna connection terminal 10*b* are provided. On the inner surface (the surface opposing the plurality of dielectric resonators 2 to 7) of the panel 8, the input/output loop 9*a* and 9*d* connected to the input/output terminals 10*a* and 10*c*, and the input/output loops 9*b* and 9*c* connected to the antenna connection terminal 10*b* are each provided. The input/output loop 9*a* generates a magnetic field in accordance with a high-frequency signal input to the input/output terminal 10*a* so that the TM double mode dielectric resonator 2 generates an electric field of the TM mode. When a signal from the TM double mode dielectric resonator 4 is received, the input/output loop 9*b* generates a magnetic field and transmits a signal to the antenna connection terminal 10*b*. The input/output loop 9*c* generates a magnetic field when a signal from the antenna connection terminal 10*b* is received so that the TM single mode dielectric resonator 5 generates an electric field of the TM mode, and the input/output loop 9*c* transmits a signal. The input/output loop 9*d* generates a magnetic field when a signal of the TM single mode dielectric resonator 7 is received, and transmits a signal to the input/output terminal 10*c*.

The inner surface (the surface opposing the plurality of dielectric resonators 2 to 7) of the panel 11 includes a coupling loop 12*a* which couples the TM double mode dielectric resonator 2 and the TM triple mode dielectric resonator 3, a coupling loop 12*b* which couples the TM triple mode dielectric resonator 3 and the TM double mode dielectric resonator 4, a coupling loop 12*c* which couples the TM single mode dielectric resonator 5 and the TM triple mode dielectric resonator 6, and a coupling loop 12*d* which couples the TM triple mode dielectric resonator 6 and the TM single mode dielectric resonator 7.

With such a construction, a dielectric filter having seven stages, formed from the TM double mode dielectric resonator 2, the TM triple mode dielectric resonator 3, and the TM double mode dielectric resonator 4, is formed. Also, a dielectric filter of five stages, formed from the TM single mode dielectric resonator 5, the TM triple mode dielectric resonator 6, and the TM single mode dielectric resonator 7, is formed. By arranging one of the dielectric filters on a transmission side and the other on a receiving side, the dielectric duplexer 1 is formed.

The operation of such a dielectric duplexer 1 is described below.

A magnetic field is generated in the input/output loop 9*a* in accordance with a high-frequency signal input from the input/output terminal 10*a*. The magnetic field of the input/output loop 9*a* overlaps with the intersection portion of the cross-shaped dielectric core of the TM double mode dielectric resonator 2, thereby causing the TM$\mathbf{110}_{x+y}$ mode to be excited by this magnetic field. This TM$\mathbf{110}_{x+y}$ mode becomes an excitation mode of the first stage of the TM double mode dielectric resonator 2. Next, the TM$\mathbf{110}_{x+y}$ mode is electromagnetically coupled to the TM$\mathbf{110}_{x-y}$ mode, and this TM$\mathbf{110}_{x-y}$ mode becomes an excitation mode of the second stage of the TM double mode dielectric resonator 2. The TM$\mathbf{110}_{x-y}$ mode is magnetically coupled to the coupling loop 12*a*, and as a result of the magnetic field generated in the coupling loop 12*a* being overlapped on the intersection portion of the dielectric core of the TM triple mode dielectric resonator 3, the TM$\mathbf{110}_{x+y}$ mode is excited in the TM triple mode dielectric resonator 3. As a result of providing a dielectric-free portion 3*d* in the corner portion of the intersection section of the recessed section 3*c* and the dielectric core, the TM$\mathbf{110}_{x+y}$ mode is electromagnetically coupled to the TM111 mode, and the TM111 mode is electromagnetically coupled to the TM$\mathbf{110}_{x-y}$ mode. Therefore, in the TM triple mode dielectric resonator 3, the TM$\mathbf{110}_{x+y}$ mode becomes an excitation mode of the first stage, the TM111 mode becomes an excitation mode of the second stage, and the TM$\mathbf{110}_{x-y}$ mode becomes an excitation mode of the third stage. The TM double mode dielectric resonator 4 operates in the same manner as the TM double mode dielectric resonator 2, and transmits a signal to the antenna connection terminal 10*b* via the input/output loop 9*b*.

The high-frequency signal which is received by the antenna and which is input from the antenna connection terminal 10*b* causes a magnetic field to be generated in the input/output loop 9*c*. This magnetic field causes a TM$\mathbf{110}_{y}$ mode to be excited in the dielectric core of the TM single mode dielectric resonator 5. The TM$\mathbf{110}_{y}$ mode is magnetically coupled to the coupling loop 12*c*, and the magnetic field generated in the coupling loop 12*c* causes a TM$\mathbf{110}_{x+y}$ mode to be excited in the TM triple mode dielectric resonator 6. In the TM triple mode dielectric resonator 6, similar to the TM triple mode dielectric resonator 3, the TM111 mode and the TM$\mathbf{110}_{x-y}$ mode are excited so that a magnetic field is generated in the coupling loop 12*d*. The TM single mode dielectric resonator 7 operates in the same manner as the TM single mode dielectric resonator 5, and transmits a signal to the input/output terminal 10*c* via the input/output loop 9*d*.

By forming the transmission side filter from the dielectric resonators 2, 3 and 4 and the receiving side filter from the dielectric resonators 5, 6 and 7, the number of stages and the degree of multiplexing of the filter on the receiving side can be decreased, and a signal received by the antenna can be transmitted, with a low loss, to circuits at subsequent stages. Conversely, by forming the transmission side filter from the dielectric resonators 5, 6, and 7 and the receiving side filter from the dielectric resonators 2, 3, and 4, the number of stages and the degree of multiplexing of the filter on the transmission side can be decreased, and thus an insertion loss due to a signal having a large input power and heat caused by this insertion loss can be suppressed.

Dielectric materials used for the construction of the foregoing dielectric resonators differ according to the degree of multiplexing thereof. Typically, a triple mode resonator uses a dielectric material having a dielectric constant lower than that of the double mode resonator and the single mode resonator. Preferably, a dielectric material having a high dielectric constant is used for the double mode dielectric resonator and the single mode dielectric resonator, and for the TM triple mode dielectric resonator, a dielectric material having a low dielectric constant is used. With this, the external dimensions can be made uniform. For example, specifically, when used in a 1.8-GHz band, an $MgTiO_3$—$CaTiO_3$-type dielectric having a specific inductive capacity $\epsilon r$ of 24 is used for the TM triple mode dielectric resonator. For the TM single mode dielectric resonator and the TM double mode dielectric resonator, a (Zr, Sn) $TiO_4$-type dielectric having a specific inductive capacity $\epsilon r$ of 38 is used. As a result, the external dimensions of the TM single mode dielectric resonator, the TM double mode dielectric resonator, and the TM triple mode dielectric resonator can be unified into a square of 25 mm.

Next, the construction of a dielectric duplexer according to a second embodiment of the present invention will be described below with reference to FIG. 2.

Figure 2:
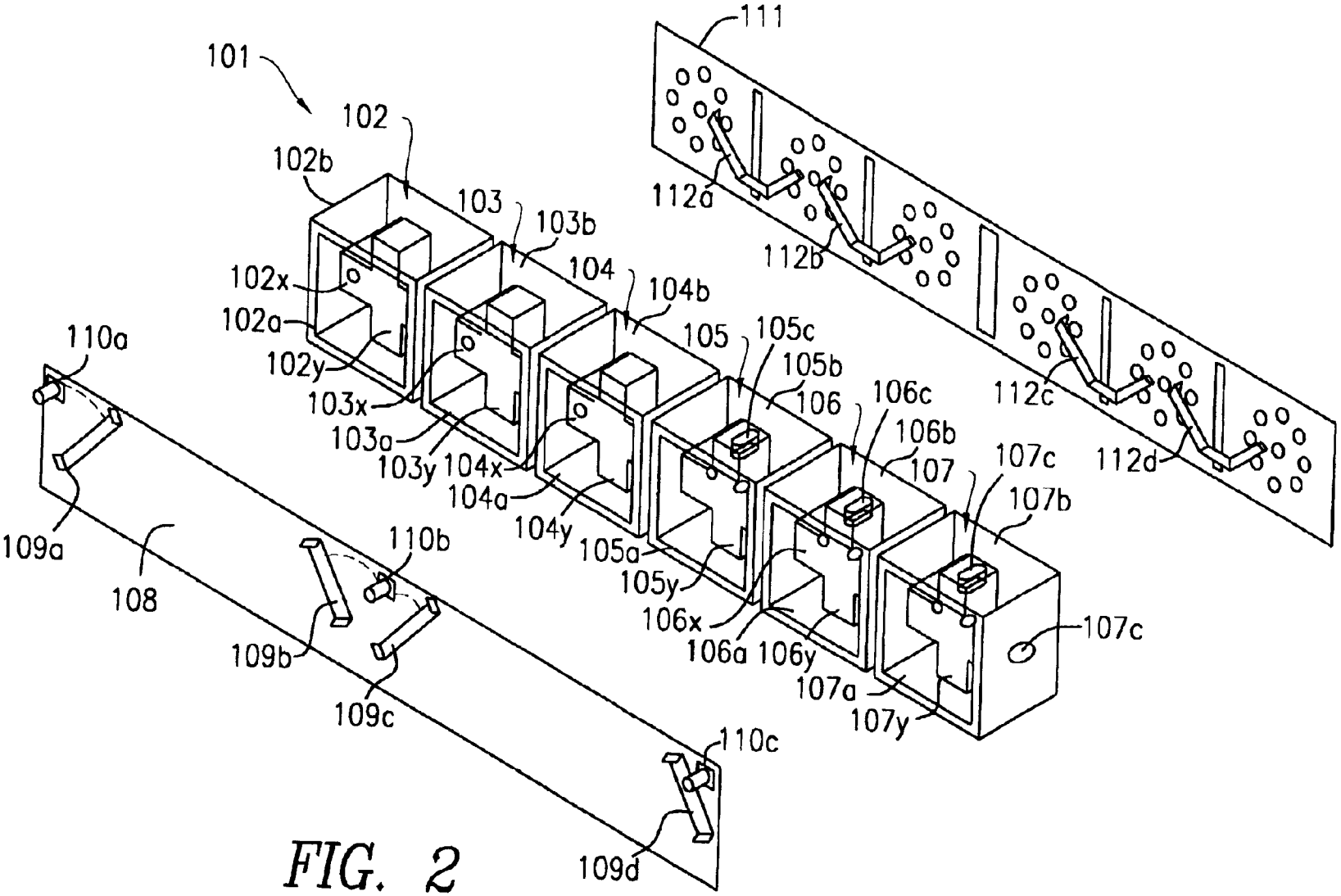
FIG. 2 is an exploded perspective view of a dielectric duplexer according to a second embodiment of the present invention.

In FIG. 2, reference numeral 101 denotes a dielectric duplexer. Reference numerals 102, 103, and 104 denote a TM double mode dielectric resonator. Reference numerals 105, 106, and 107 denote a TM triple mode dielectric resonator. Reference numerals 102*a*, 103*a*, 104*a*, 105*i*, 106*a*, and 107*a* denote a cavity. Reference numerals 102*b*, 103*b*, 104*b*, 105*b*, 106*b*, and 107*b* denote a conductor. Reference numerals 102*x*, 103*x*, 104*x*, and 106*x* denote a dielectric core horizontal section (the horizontal sections of resonators 105 and 107 are not labeled in FIG. 2). Reference numerals 102*y*, 103*y* 104*y*, 105*y*, 106*y*, and 107*y* denote a dielectric core vertical section. Reference numerals 105*c*, 106*c*, and 107*c* denote a recessed section. Reference numerals 108 and 111 denote a panel. Reference numerals 109*a*, 109*b*, 109*c*, and 109*d* denote an input/output loop. Reference numerals 110*a* and 110*c* denote an input/output terminal. Reference numeral 110*b* denotes an antenna connection terminal. Reference numerals 112*a*, 112*b*, 112*c*, and 112*d* denote a coupling loop.

The dielectric duplexer shown in FIG. 2 is formed in such a way that a transmission side dielectric filter of six stages is formed from the three TM double mode dielectric resonators 2, 3, and 4, and a receiving side dielectric filter of nine stages is formed from the three TM triple mode dielectric resonators 5, 6, and 7. The remaining construction is the same as that of the dielectric duplexer shown in FIG. 1. In this manner, a plurality of the dielectric resonators which form one of the filters may be the same.

With this construction, since a plurality of resonators which form a filter are the same, the construction is simple, and assembly is easy. Furthermore, since the degree of multiplexing of a dielectric resonator which forms each filter differs, a filter having a low insertion loss on the transmission and receiving sides can be easily formed.

Figure 3:
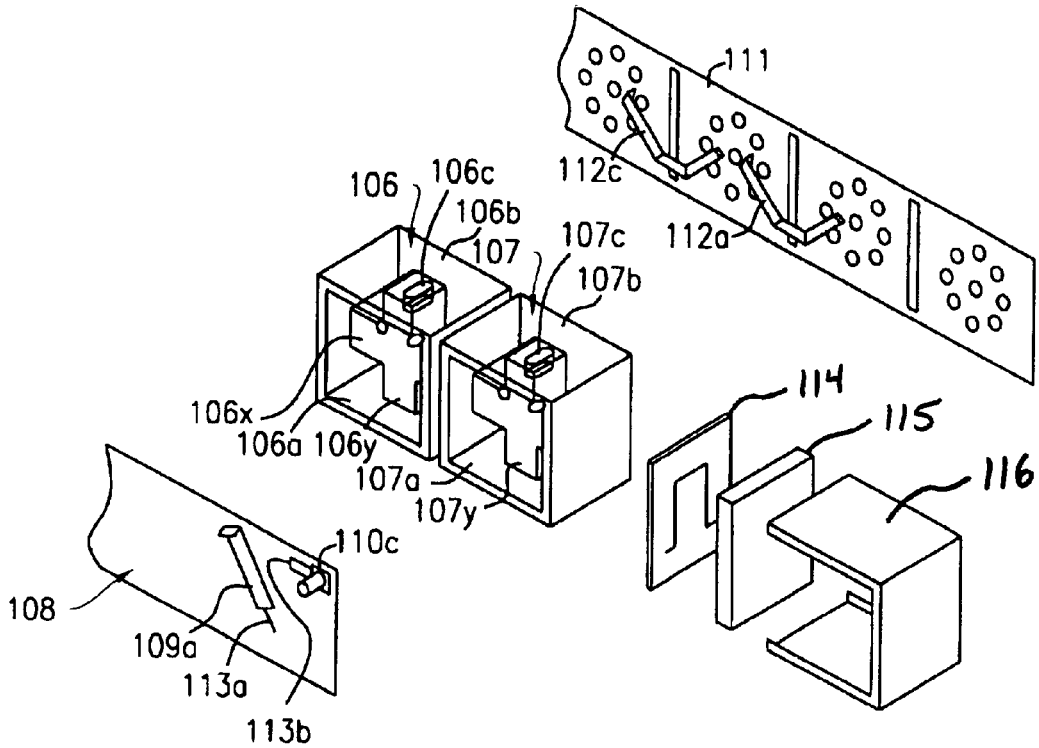
FIG. 3 is a partial view of an exploded perspective view of a dielectric duplexer according to a third embodiment of the present invention.

Next, the construction a dielectric duplexer according to a third embodiment of the present invention will be described below with reference to FIG. 3. In FIG. 3, similar elements to those shown in FIG. 2 are indicated by the same reference numerals.

The dielectric duplexer shown in FIG. 3 is one that includes a spurious trap substrate 114, a BEF (band-elimination filter) cover 115, and a dummy case 116 provided in the dielectric duplexer shown in FIG. 2. The remaining construction is the same as that of the dielectric duplexer shown in FIG. 2.

In the dielectric duplexer shown in FIG. 3, the signal output from the TM triple mode dielectric resonator 107 is input to the spurious trap substrate 114 via the input/output loop 109*a* and the connection cable 113*a*. The spurious trap substrate 114 is formed with a filter circuit so that unwanted frequency components are attenuated. In the spurious trap substrate 114, a signal indicating that the unwanted frequency components are attenuated is output to the input/output terminal 110*c* via the connection cable 113*b*. Here, the BEF cover 115 is provided on the side of the spurious trap substrate 114 opposite the dielectric resonator 107 so that the spurious trap substrate 114 is shielded from the outside. The dummy case 116 covers these two elements, and is preferably uniformly formed with the same external dimensions as those of the TM multiplex mode dielectric resonator.

With such a construction, a dielectric duplexer having improved characteristics can be formed. As a result of providing a dummy case having the same dimensions as one of the dielectric resonators, the overall dimensions of the muliplex mode dielectric resonator is changed similar to that of adding another dielectric resonator. Therefore, sharing parts is made possible, and the costs can be decreased.

Next, the construction of a communication apparatus according to an aspect of the present invention will be described below with reference to FIG. 4.

Figure 4:
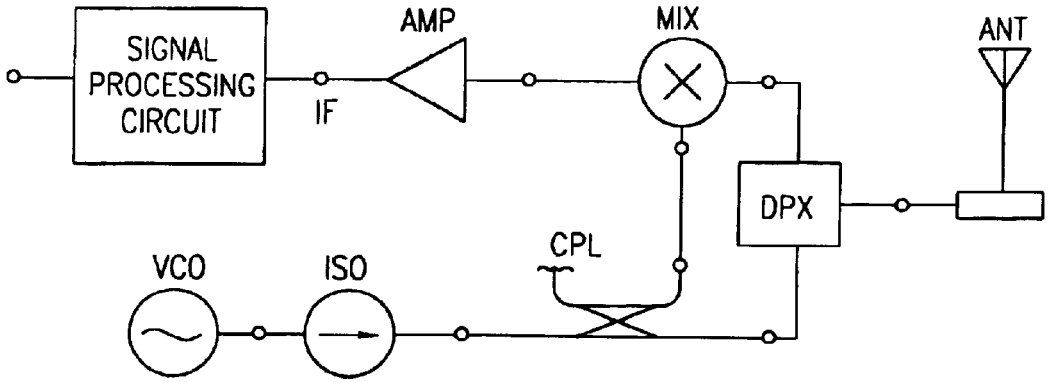
FIG. 4 is a block diagram of a communication apparatus according to an aspect of the present invention.

In FIG. 4, reference character VCO denotes a voltage-controlled oscillator. Reference character ISO denotes an isolator. Reference character CPL denotes a directional coupler. Reference character DPX denotes a duplexer. Reference character MIX denotes a mixer. Reference character AMP denotes an amplifier. An oscillation signal of the voltage-controlled oscillator VCO is transmitted from an antenna ANT via the isolator ISO, the directional coupler CPL, and the duplexer DPX. The signal received from the antenna is input to the mixer MIX via the duplexer DPX. The mixer MIX mixes this signal and a signal from the directional coupler CPL, and generates an intermediate-frequency signal. The amplifier AMP amplifies this intermediate signal and outputs the resulting signal as an intermediate-frequency signal IF to the signal processing circuit.

For the duplexer DPX portion shown in FIG. 4, a dielectric duplexer comprising a TM multiplex dielectric resonator having a construction shown in FIGS. 1 to 3 can be used. As a result, a small high-frequency module having superior communication characteristics can be easily formed.

What is claimed is:

1. A dielectric duplexer comprising:

a first dielectric filter on a transmission side and a second dielectric filter on a receiving side, the first dielectric filter comprising a first plurality of TM mode dielectric resonators having a cavity with an opening surface and a dielectric core placed within the cavity, the second dielectric filter comprising a second plurality of TM mode dielectric resonators having a cavity with an opening surface and a dielectric core placed within the cavity wherein a degree of multiplexing of at least one resonator of the first plurality of TM mode dielectric resonators differs from a degree of multiplexing of the other TM mode dielectric resonators of the first plurality of TM mode dielectric resonators, wherein a degree of multiplexing of at least one resonator of the second plurality of TM mode dielectric resonators differs from a degree of multiplexing of the other TM mode dielectric resonators of the second plurality of TM mode dielectric resonators, wherein the first and second dielectric filters are configured such that each resonator of the first and second plurality of TM mode dielectric resonators are arranged adjacent to one another with the opening surface of each cavity facing in the same direction and that the adjacent TM mode dielectric resonators are coupled to each other, and wherein a combination of the first plurality of TM mode dielectric resonators which comprise the first dielectric filter on the transmission side differs from a combination of the second plurality of TM mode dielectric resonators which comprise the second dielectric filter on the receiving side.

2. A communication apparatus comprising a dielectric duplexer according to claim 1.

3. A dielectric duplexer comprising:

a first dielectric filter on a transmission side and a second dielectric filter on a receiving side, the first dielectric filter comprising a first plurality of TM mode dielectric resonators having a cavity with an opening surface and a dielectric core placed within the cavity, the second dielectric filter comprising a second plurality of TM mode dielectric resonators having a cavity with an opening surface and a dielectric core placed within the cavity, wherein a degree of multiplexing of at least one resonator of the first plurality of TM mode dielectric resonators differs from a degree of multiplexing of the other TM mode dielectric resonators of the first plurality of TM mode dielectric resonators, wherein a degree of multiplexing of at least one resonator of the second plurality of TM mode dielectric resonators differs from a degree of multiplexing of the other TM mode dielectric resonators of the second plurality of TM mode dielectric resonators, wherein the first and second dielectric filters are configured such that each resonator of the first and second plurality of TM mode dielectric resonators are arranged adjacent to one another with the opening surface of each cavity facing in the same direction and that the adjacent TM mode dielectric resonators are coupled to each other, wherein the combination of the first plurality of TM mode dielectric resonators which comprise the first dielectric filter on the transmission side differs from the combination of the second plurality of TM mode dielectric resonators which comprise the second dielectric filter on the receiving side, and wherein the dielectric constant of a dielectric used to comprise the resonators is different between TM mode dielectric resonators having different degrees of multiplexing so that external dimensions of the cavities of each TM mode dielectric resonator are substantially the same.

4. A communication apparatus comprising a dielectric duplexer according to claim 3.

* * * * *